United States Patent [19]

Biller

[11] 4,414,527

[45] Nov. 8, 1983

[54] CONTACT ASSEMBLY FOR A FUSE CUTOUT

[75] Inventor: Bruce A. Biller, Chicago, Ill.

[73] Assignee: S&C Electric Company, Chicago, Ill.

[21] Appl. No.: 314,636

[22] Filed: Oct. 26, 1981

Related U.S. Application Data

[63] Continuation of Ser. No. 132,924, Mar. 24, 1980, abandoned.

[51] Int. Cl.[3] ..... H01H 85/22

[52] U.S. Cl. ..... 337/180; 337/169

[58] Field of Search ..... 337/168-181, 337/190, 281, 282, 291

[56] References Cited

U.S. PATENT DOCUMENTS 2,745,923 5/1956 Lindell ..... 337/180

*Primary Examiner*—William H. Beha, Jr.

*Attorney, Agent, or Firm*—J. D. Kaufmann

[57] ABSTRACT

An improved cutout which accepts a fuse tube of standard length, which is less costly to manufacture and which exhibits improved performance, has an offset, rather than a straight, recoil bar. The offset positions the end of the recoil bar closer to the short leg of a J Spring, and positions a hole in the end of the recoil bar, through which freely passes a pin interconnecting the legs of the J, closer to a convexity in the short leg. Operation of the cutout causes a fuse tube, one end of which is in the concavity, to experience random longitudinal and transverse thrust forces. The offset limits the transverse motion the short J leg and the fuse tube can experience to (a) limit bending forces on the tube and breakage thereof, and (b) prevent the fuse tube from disengaging the concavity before the longitudinal thrust thereof subsides. The offset also ensures that longitudinal thrust forces on the tube are simultaneously transferred from the one end of the fuse tube to the recoil bar and from the other end of the tube to a contact assembly opposite from the recoil bar.

12 Claims, 8 Drawing Figures

PRIOR ART

CONTACT ASSEMBLY FOR A FUSE CUTOUT

This is a continuation of application Ser. No. 132,924, filed Mar. 24, 1980, now abandoned.

BACKGROUND OF THE INVENTION

1. Field of the Invention

The present invention relates to an improved fuse cutout and, more particularly, to an improved fuse cutout which is less expensive to manufacture than prior art fuse cutouts, but which exhibits improved operating performance notwithstanding the decrease in expense thereof. The improved fuse cutout of the present invention may be used with a fuse link of the type described and claimed in commonly assigned, co-filed U.S. Pat. No. 4,317,099 issued Mar. 23, 1982 in the name of Richard J. Sabis. The cutout of this application may also include an improved fuse tube as described and claimed in commonly assigned, co-filed U.S. Pat. No. 4,313,100 issued Jan. 26, 1982 in the name of William E. Schmunk.

2. Discussion of the Prior Art

Fuse cutouts and fuse links therefor are well known. A typical fuse cutout includes a hollow insulative fuse tube having conductive ferrules mounted to the opposite ends thereof. One ferrule (often called the "exhaust" ferrule) is located at an exhaust end of the fuse tube and usually includes a trunnion casting which interfits with a trunnion pocket of a first contact assembly carried by one end of a porcelain or similar insulator. The other ferrule is normally held and latched by a second contact assembly carried by the other end of the porcelain insulator so that the fuse tube is normally parallel to, but spaced from, the porcelain insulator. The porcelain insulator is mountable to the cross-arm of a utility pole or a similar structure. The fuse link is located within the fuse tube with its ends respectively electrically continuous with the ferrules. One point of an electrical circuit is connected to the first contact assembly, while another point of the circuit is connected to the second contact assembly. Often, the insulator and the fuse tube are oriented perpendicular to the ground so that the exhaust ferrule and the first contact assembly are located below the other ferrule and the second contact assembly.

The fuse tube may include a high burst strength outer portion—for example, a fiber-glass-epoxy composite—lined with or containing an ablative arc-extinguishing material, such as horn fiber or bone fiber.

Normal currents flowing through the electrical circuit flow without affecting the fuse link. Should a fault current or other over-current, to which the fuse link is designed to respond, occur in the circuit, the fuse link operates as described below. Operation of the fuse link permits the upper ferrule to disengage itself from the upper contact assembly, whereupon the fuse tube rotates downwardly due to coaction of the trunnion casting and the trunnion pocket. If the fuse link operates properly, current in the circuit is interrupted and the rotation of the fuse tube gives a visual indication that the cutout has operated to protect the circuit.

Typical fuse links include a first terminal and a second terminal, between which there is normally connected a fusible element made of pure silver, silver-tin, or the like. Also connected between the terminals may be a strain wire, for a purpose described below. The second terminal is electrically continuous with, and is usually mechanically connected to, a button assembly, which is engagable by a portion of the upper ferrule on the fuse tube. The first terminal is connected to a flexible, stranded length of cable. Surrounding at least a portion of the second terminal, the fusible element, the strain wire (if used), the first terminal, and some portion of the flexible stranded cable is a sheath. The sheath is typically made of a so-called ablative arc-extinguishing material (such as horn fiber) or is a cellulosic material impregnated with an ablative arc-extinguishing material (such as boric acid). Such ablative arc-extinguishing materials are well known and comprise compounds or compositions which, when exposed to the heat of a high-voltage arc, ablate to rapidly evolve large quantities of deionizing turbulent and cooling gases. Typically, the sheath is much shorter than the fuse tube and terminates short of the exhaust end of the fuse tube.

The free end of the stranded cable exits the fuse tube from the exhaust end thereof and has tension or pulling force maintained thereon by a springloaded flipper on the trunnion casting. The tension or pulling force exerted on the cable by the flipper attempts to pull the cable and the first terminal out of the sheath and out of the fuse tube. The force of the flipper is normally restrained by the strain wire, typical fusible elements not having sufficient mechanical strength to resist this tension or pulling force.

In the operation of typical cutouts, a fault current or other over-current results, first, in the melting or vaporization of the fusible element, followed by the melting or vaporization of the strain wire. Following such melting or vaporization, a high-voltage arc is established between the first and second terminals within the sheath and the flipper is now free to pull the cable and the first terminal out of the sheath and, ultimately, out of the fuse tube. As the arc forms, the arc-extinguishing materials of the sheath begin to ablate and high quantities of de-ionizing, turbulent and cooling gases are evolved. The movement of the first terminal under the action of the flipper, and the subsequent rapid movement thereof due to the evolved gases acting thereon as on a piston, results in elongation of the arc. The presence of the de-ionizing, turbulent and cooling gas, plus arc elongation, may, depending on the level of the fault current or other over-current, ultimately result in extinction of the arc and interruption of the current at a subsequent current zero. The loss of the tension on the stranded cable originally effected by the flipper permits the trunnion casting to experience some initial movement relative to the exhaust ferrule which permits the upper ferrule to disengage itself from the upper contact assembly. This initiates a downward rotation of the fuse tube and its upper ferrule to a so-called "drop out" or "drop down" position.

As noted immediately above, arc elongation within the sheath and the action of the evolved gases may extinguish the arc. At very high fault current or over-current levels, however, arc elongation and the sheath may not, by themselves, be sufficient to achieve this end. Simply stated, at very high fault current levels, either the sheath may burst (because of the very high pressure of the evolved gas) or insufficient gas may be evolved therefrom to quench the high current level arc. For these reasons, the fuse tube is made of, or is lined with, ablative arc-extinguishing horn fiber or bone fiber, as noted above. In the event the sheath bursts, the arc-extinguishing material of the fuse tube interacts with the arc; gas evolved as a result thereof effects arc extinction. If the sheath does not burst, the arc-extinguishing material of the fuse tube between the end of the sheath and the exhaust end of the fuse tube is nevertheless available for evolving gas, in addition to that evolved from the sheath. The joint action of the two quantities of evolved gas, together with arc elongation, extinguish the arc.

Many manufacturers of cutouts and fuse links of the types described above continue to make concerted efforts to decrease the costs of the material and labor thereof, both as a matter of simple, good commercial practice, and in view of the fact that certain materials, such as silver, copper, and bronze, continue to experience large price increases. At the same time, manufacturers of cutouts and fuse links continue ongoing programs to improve the performance of these products. A less expensive, improved performance fuse cutout is a primary goal of the present invention.

The upper or second contact assembly usually includes a J-shaped spring contact, an end of the long leg of which is mounted for flexing to a rigid recoil bar. The recoil bar extends to a position between the legs of the J. A pin interconnects the legs of the J for conjoint movement. The pin passes through an aperture in a bushing pressed into, and extending beyond, a hole through the recoil bar and is connected to the opposite side of a concavity formed in the J's short leg. The concavity engages and holds an end of the fuse tube, as described below.

A spring acts between the recoil bar and the concavity to set a "rest" position of the J's short leg (and of the J's long leg). Upward deflection of the J's short leg is limited by abutment between the opposite side of the concavity and the bushing.

The lower or first contact assembly includes a feature—a projection, stud or the like—normally spaced from a similar feature or surface on the exhaust ferrule. The normal spacing between these features is substantially the same as the normal spacing between the opposite side of the concavity and the bushing.

When a fuse tube is properly positioned between the contact assemblies, the J's short leg is held away from its rest position against the bias of both the spring and the long leg to firmly engage a contact cap on the upper ferrule of the fuse tube in the concavity. When the fuse link operates, gases evolved within the fuse tube thrust it against the J's short leg in jet-like fashion further compressing the spring and flexing the J's long leg. The fuse tube may also randomly move the pin transversely at this time until the pin engages the walls of the aperture in the bushing. The random, transverse fuse tube movement may be viewed as precession of the pin between a pair of "pivots," one of which is the pin's connection to the J's short leg, the other of which is the envelope of the points of contact between the pin and the walls of the bushing aperture. This random, transverse fuse tube movement may have several deleterious effects.

First, ideally the features on the first contact assembly and the exhaust ferrule abut at the same time the opposite side of the concavity abuts the bushing. This transfers the forces on the fuse tube simultaneously to the contact assemblies. If the fuse tube moves too far transversely during its thrusting, these abutting events will not be simultaneous.

Second, ideally the contact cap should not disengage the concavity until the fusible elements of the fuse link completely melts to release the tension in the cable and until the initial thrust of the fuse tube subsides. Release of this tension and subsiding of fuse tube thrust permits a limited amount of relative movement between the exhaust ferrule and the trunnion casting about a toggle joint therebetween. This limited movement permits the contact cap to move out of the concavity and the fuse tube to fall "open" due to rotation of the trunnion casting in the trunnion pocket. If the fuse tube moves too far transversely during its thrusting, the contact cap may disengage the concavity too early.

Third, transverse movement of the fuse tube can apply a bending movement thereon. This bending movement can fracture the fuse tube near the exhaust ferrule.

Any solution to the above problems must take into account that presently available fuse tubes have "standard" lengths, which depend, inter alia, upon the voltage of the circuit to which the cutout is connected. Any such solution must not alter the cutout so as to require non-standard fuse tube lengths.

The present invention, then, is intended to solve the above-described problems, while achieving the overall goals of improving fuse cutout performance, while at the same time decreasing its cost.

SUMMARY OF THE INVENTION

According to the present invention, there is provided an improved fuse cutout. The cutout includes a mounting having a first and a second contact assembly. A fuse tube of selected length is to be supported between the contact assemblies. The improved cutout includes an improved second contact assembly having certain old elements. The second contact assembly includes a generally J-shaped spring contact. A long leg of the J is attached to a rigid recoil bar, a portion of which extends into the space between the legs of the J. The short leg of the J has a concavity formed therein and a complementary convexity. The concavity selectively receives an end of the fuse tube. A pin freely passes through a hole in the extending portion of the recoil bar and is attached between the long leg and the convexity. Both legs of the J are thus constrained to move together as the pin moves through the hole and the long leg flexes out of a rest position about its point of attachment to the recoil bar. A spring acts between a washer on the apex of the convexity and the recoil bar to set the rest position of the long leg.

Closure of the cutout by rotating the fuse tube in the first contact assembly inserts the fuse tube end into the concavity so that the legs of the J are deflected against the action of the spring and the flexing of the long leg out of its rest position. When the cutout operates, the fuse tube thrusts both against and transverse to the concavity. This thrust applies a bending force to the fuse tube which may fracture as a consequence. The thrust also randomly moves the J's short leg transverse to the pin until the pin engages the walls of the hole. Moreover, the thrust further deflects the legs against the action of the spring and the flexing of the long leg.

In the improved cutout, an offset is formed in the recoil bar. This offset positions the extending portion of the recoil bar and the hole substantially closer to the short leg and the convexity. This closer positioning limits the extent of the random transverse motion of the short leg before the pin engages the hole walls. Consequently, the bending force on the fuse tube is limited. The offset also positions the convexity closer to the recoil bar to decrease the amount of movement of the short leg before it engages the recoil bar. This earlier transfers the thrust-caused force to the recoil bar.

Often the fuse tube and the first contact assembly each have a feature or projection which are normally spaced apart. When the legs further deflect due to cutout operation, these features engage. In other aspects of the improved cutout, the distance between the convexity and the recoil bar after cutout closure, but before further leg deflection, is equal to the normal spacing between the features. Thus, thrust-caused force on the fuse tube is simultaneously transferred to the first contact assembly and the recoil bar.

The above improvements do not alter the typical spacing between the concavity and the first contact assembly. Thus, fuse tubes of standard length may be used in the cutout without alteration.

In cutouts, it is desirable that the fuse tube end not disengage the concavity until the initial thrust of the fuse tube subsides. If the fuse tube moves too far transversely during its thrusting, the fuse tube end may disengage the concavity too early. The offset limits the amount of transverse pin movement and, hence, of transverse fuse tube movement. This prevents too early disengagement of the fuse tube and from the concavity.

DETAILED DESCRIPTION

Figure 1:
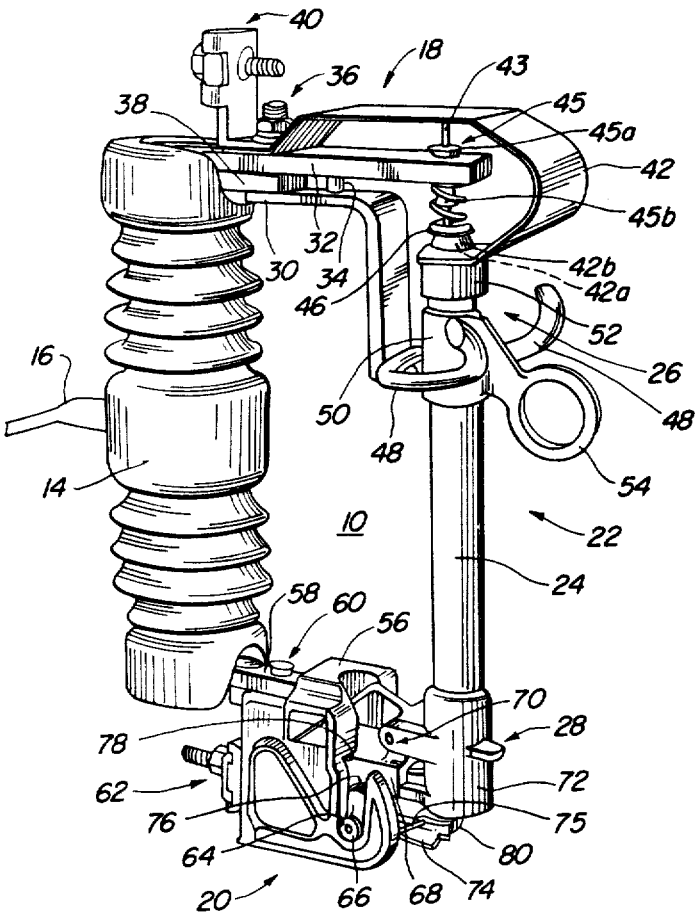
FIG. 1 is an elevational, perspective view of a fuse cutout according to the prior art.
Figure 5:
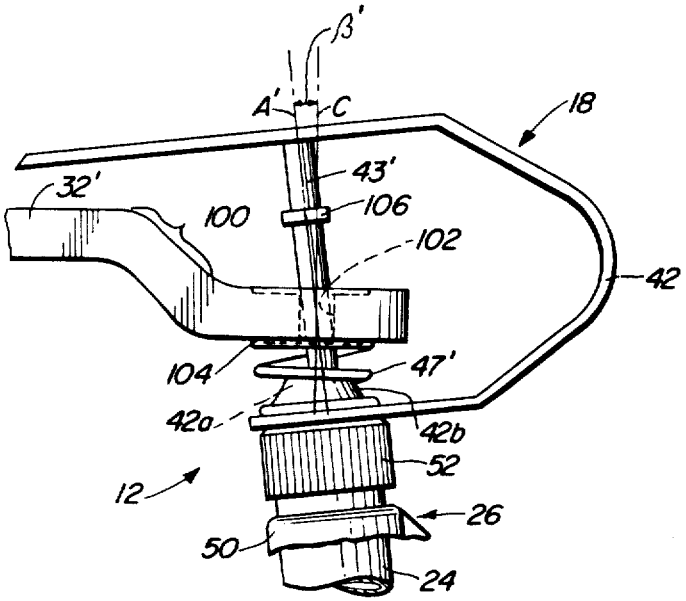
FIG. 5 is an enlarged elevational view similar to FIG. 4*a* during operation of the cutout of FIG. 3.
Figure 3:
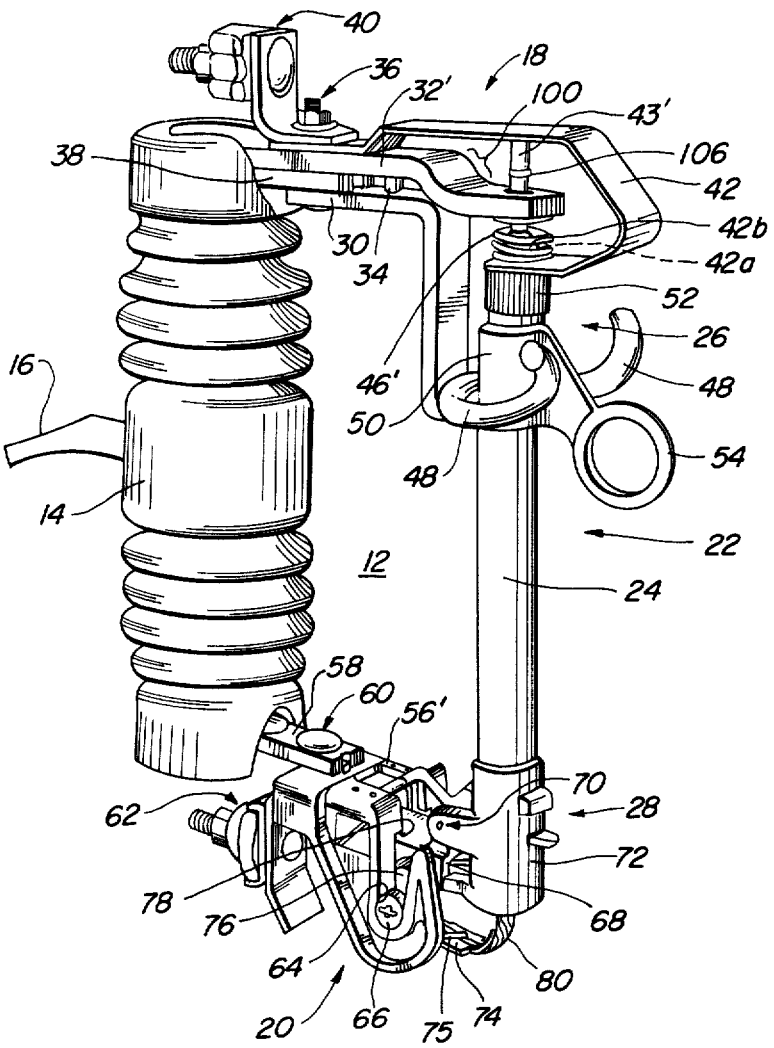
FIG. 3 is an elevational, perspective view of an improved fuse cutout according to the present invention.

Referring first to FIG. 1, there is shown a fuse cutout 10 according to the prior art. An improved cutout 12 according to the present invention is shown in FIGS. 3–5 and is described later. The same or similar reference numerals are used for corresponding elements of the cutouts 10 and 12. The improved fuse cutout 12 of the present invention operates in a similar, but improved, manner to that of the prior art fuse cutout 10, and is also less costly.

The prior art cutout 10 includes an elongated, skirted insulator 14 which has affixed thereto a mounting member 16. The mounting member 16 permits mounting of the insulator 14 and the fuse cutout 10 to an upright or a crossarm of a utility pole (not shown). The insulator 14 may be made of porcelain or similar material.

Affixed to the upper end of the insulator 14 is an upper contact assembly generally designated 18. Affixed to the lower end of the insulator 14 is a lower contact assembly 20. The cutout 10 also includes a fuse tube assembly 22 which in the normal or unoperated condition of the cutout 10 may be maintained in the vertical position shown in FIG. 1, although other orientations may be desirable. Specifically, the fuse tube assembly 22 includes an insulative fuse tube 24 of a well-known type, which may comprise an epoxy-fiberglass composite outer shell lined with horn fiber or bone fiber. Mounted or affixed to the upper end of the fuse tube 24 is an upper ferrule assembly 26, while at the opposite lower or exhaust end of the fuse tube 24 is a lower or exhaust ferrule assembly 28. In the position of the fuse tube assembly 22 depicted in FIG. 1, the lower ferrule assembly 28 is held by the lower contact assembly 20, while the upper ferrule assembly 26 is held, and latched against movement, by the upper contact assembly 18.

The upper contact assembly 18 includes a support bar 30 bent at the 90° angle shown and a straight recoil bar 32 which runs generally parallel to a portion of the support bar 30. The bars 30 and 32 are connected together and spaced apart by a rivet or stud 34. Near the rivet or stud 34, the two bars 30 and 32 are mounted by a nut and bolt combination 36 to a mount 38, which is attached to the top of the insulator 14. Also held by the nut and bolt 36 is a connector 40, such as a parallel groove connector. The connector 40 facilitates the connection to the upper contact assembly 18 of one cable or conductor of a high-voltage circuit.

The upper contact assembly 18 also includes a generally J-shaped spring contact 42. The long leg of the spring contact 42 is attached, as shown in FIG. 1, to the upper surface of the recoil bar 32 in the vicinity of the nut and bolt 36. The J curves out, down and back into a short leg, so that the recoil bar 32 is positioned between the legs of the contact 42. Formed in the short leg of the spring contact 42 is an indentation or concavity 42*a*. A stud or rod 43 freely passes through an aperture 44 (not numbered in FIG. 1; See FIGS. 2 and 2*a*) in a bushing 45 pressed into a hole (not numbered) through the end of the recoil bar 32 and is firmly attached between the legs of the spring contact 42. Preferably, the pin 43 is attached to the short leg of the spring contact 42 so that its axis is coaxial with the axis of the indentation or concavity 42*a* formed in the short leg, both axes being labeled A in FIG. 2. Thus, although the spring contact 42 may flex near the nut and bolt 36, the legs (interconnected by the pin 43) are constrained to move together. The bushing 45 extends both above the recoil bar 32, as shown at 45*a*, and below the recoil bar 32, as shown at 45*b*.

Acting between the lower surface of the recoil bar 32 and a washer 46 at the top of a convexity 42*b* formed in the short leg of the spring contact 42 complementarily with the indentation or concavity 42*a* is a backup spring 47 which sets a rest position for the legs of the spring contact 42. The upper turns of the backup spring 47 surround the extending portion 45*b* of the bushing 45.

The downwardly bent portion of the support bar 30 may have mounted thereto attachment hooks 48.

The upper ferrule assembly 26 includes a cast ferrule 50, which is attached or mounted to the upper end of the fuse tube 24. The ferrule 50 may include a threaded portion (not shown) onto which may be threaded a contact cap 52. The contact cap 52 is configured so as to fit into and be held by the indentation or concavity 42*a* formed in the short leg of the spring contact 42 when the fuse tube assembly 22 is in the position shown in FIGS. 1 and 2. The ferrule 50 may also include a pull ring 54. The pull ring 54 may be engaged by a hot stick or switch stick to move the upper ferrule assembly 26 away from the upper contact assembly 18 while the lower ferrule assembly 28 rotates in the lower contact assembly 20, as described below. In view of the nature of high voltage circuits, this opening movement of the fuse tube assembly 22 must be effected while the circuit connected to the cutout 10 is de-energized or else an arc will form between the upper ferrule assembly 26 and the upper contact assembly 18. The fuse tube assembly 22 may also be opened by initially attaching between the attachment hooks 48 and the pull ring 54 a portable load-break tool. Such a portable load-break tool permits the fuse tube assembly 22 to be opened with the circuit energized, momentarily having transferred thereto the flow of current in the circuit 10 and interrupting such current internally thereof.

The lower contact assembly 20 includes a support member 56 attached to a mount 58 by a nut and bolt combination 60. The support member 56 may also carry a connector 62, such as a parallel groove connector. The connector 62 facilitates the connection to the lower contact assembly 20 of another cable or conductor of the high-voltage circuit in which the fuse cutout 10 is to be used. It should be noted that connectors 40 and 62 may both take the form of that described and claimed in commonly assigned U.S. patent application Ser. No. 218,867, filed Dec. 22, 1980 as a continuation of, Ser. No. 60,947 filed July 26, 1979, now both abandoned, in the name of Hiram Jackson.

Formed in the support member 56 are trunnion pockets 64. The trunnion pockets 64 are designed to hold outwardly extending portions 66 of a trunnion casting 68 which is pivotally mounted at a toggle joint 70 to a cast ferrule 72 which is attached or mounted to the lower or exhaust end of the fuse tube 24. As hereinafter described, the trunnion casting 68 and the cast ferrule 72 are normally rigidly held in the relative position depicted in FIG. 1. In this normal relative position of the trunnion casting 68 and the ferrule 72, the contact cap 52 may be engaged by and held in the concavity 42*a* formed in the short leg of the spring contact 42 to maintain the fuse tube assembly 22 in the position depicted in FIG. 1. Also, as described in more detail below, when a fuse link within the fuse tube 24 operates, the trunnion casting 68 and the ferrule 72 are no longer so rigidly held, and the ferrule 72 may rotate downwardly relative to the trunnion casting 68 about the toggle joint 70. This movement of the ferrule 72 permits the contact cap 52 to disengage the spring contact 42, following which the entire fuse tube assembly 22 rotates about the lower contact assembly 20 via rotation of the extending portions 66 in the trunnion pockets 64.

Rotatably mounted to the trunnion casting 68 is a flipper 74. A spring 75 mounted between the trunnion casting 68 and the flipper 74 biases the flipper 74 away from the lower or exhaust end of the fuse tube 24.

The trunnion casting 68 includes shoulders 76 or other features. The support member 56 also includes features, such as shoulders 78, normally spaced from the shoulders 76 when the extending portions 66 of the trunnion casting 68 are seated in their respective trunnion pockets 64. The normal spacing between the shoulders 76 and 78 is about equal to the normal spacing between the washer 46 and the extending portion 45*b* of the bushing 45. It should be noted that the pin 43 is free to move transversely (or to precess) between its attachment to the convexity 42*b* and its engagement with the walls of the aperture 44 through the bushing 45, as shown in FIG. 2*a*.

To use the fuse cutout 10, the fuse tube assembly 22 is first "armed" with a fuse link. Suffice it here to say that the contact cap 52 is removed and the fuse link is inserted into the interior of the fuse tube 24 from the upper end thereof. A portion of the fuse link abuts a shoulder (not shown) at the top of the ferrule 50, following which the contact cap 52 is threaded back onto the ferrule 50. A flexible stranded cable 80 forming a part of the fuse link exits an exhaust opening in the lower or exhaust end of the fuse tube 24. The flipper 74 is manually rotated against the action of the spring 75 to position it adjacent the exhaust opening following which the cable 80 is laid into a channel in the flipper 74. Following this, the cable 80 is wrapped around a flanged bolt (not shown) which is threaded into the trunnion casting 68. Following tightening of the flanged bolt to hold the cable 80, the flipper 74 is maintained against the bias of the spring 75 in the position shown in FIG. 1, whereat there is a constant tension force applied to the cable 80 and, accordingly, to the fuse link within the fuse tube 24. It is this connection of the cable 80 to the trunnion casting 68 by the flanged bolt and the action of the spring 75 on the flipper 74 which normally holds the trunnion casting 68 and the ferrule 72 in the position depicted in FIG. 1 relative to the toggle joint 70.

Following operation of a fuse link within the fuse tube 24, the flipper 74 is able to move the cable 80 downwardly within the fuse tube 24. The release of the tension force applied to the cable 80 by the flipper 74 permits relative movement of the ferrule 72 and the trunnion casting 68 about the toggle joint 70 to permit separation of the contact cap 52 from the spring contact 42.

Ideally, the relative movement of the ferrule 72 and the trunnion casting 68 occurs after tension in the cable 80 is released and after an initial upward thrust of the fuse tube 24 subsides. As set forth more fully in the abovenoted U.S. Pat. No. 4,317,099 when a fusible element (not shown) of the fuse link within the fuse tube 24 melts, there follows the rapid evolution of arc-extinguishing gas within the fuse tube 24. This evolved gas exits the exhaust opening of the fuse tube 24 at a very rapid rate, thrusting the fuse tube 24 upwardly in jet-like fashion. Before the cutout 10 is closed—i.e., before the fuse tube assembly 22 is rotated, by rotating the extensions 66 of the trunnion casting 68 in the trunnion pockets 64 of the support member 56, until the contact cap 52 engages the concavity 42*a*—the spring 47 and the long leg of the contact 42 set a rest position for the legs of such contact 42. In this rest position, the convexity 42*b* and the washer 46 are spaced from the portion 45*b* of the bushing 45. After the cutout 10 is closed, the contact cap 52 deflects the short leg of the J 42 (and also, flexes the long leg) upwardly against the spring bias of the spring 47 and of the long leg to descrease the spacing between the washer 46 and the bushing portion 45 to equal the spacing between the shoulders 76 and 78. This situation obtains until the fuse link within the fuse tube 24 operates in response to a fault current.

When the fuse link operates, the tension on the cable 80 is released at the same time the fuse tube 24 thrusts up. Ideally, such thrust occurs while the fuse tube 24, the pin 43, and the aperture 44 remain coaxial. If such coaxial relation obtains, the relative movement of the ferrule 72 and the trunnion casting 68 about the toggle joint 70 does not immediately occur—though it is able to occur because of the release of tension in the cable 80—due to the thrust of the fuse tube 24. This thrust, therefore, results in simultaneous engagement of the shoulders 76 and 78 at one end of the fuse tube 24 and of the washer 46 and the bushing portion 45*b* at the other end of the fuse tube 24. These simultaneous engagements transfer the thrust forces on the fuse tube assembly 22 more or less equally to the contact assemblies 18 and 20 until the thrust subsides. As the thrust subsides and the fuse tube assembly 22 begins to move back down under the action of the spring 47 and the long leg of the J 42, (1) the shoulders 76 and 78, and the washer 46 and the bushing portion 45*b* separate, and, (2) the aforedescribed relative movement of the ferrule 72 and the trunnion casting 68 occurs. This relative movement permits the contact cap 52 to disengage the concavity 42*a* and the fuse tube assembly 22 to rotate to a "drop out" position via rotation of the extensions 66 in the trunnion pockets 64. All of the above is "timed" so that rotation of the assembly 22 is initiated as or after the fuse link has interrupted current in the circuit.

Random, deleterious deviations from the ideal operation of the cutout 10 have been detected. Specifically and referring to FIG. 2*a*, during thrusting of the fuse tube 24, the tube 24 has been observed to move transversely, which may cause transverse movement or precession of the pin 43 between the convexity 42*b* and the aperture 44 in the bushing 45, as shown by the angle B between the axis A of the pin 43 and the axis C of the aperture 44. Several improper results may flow from these transverse movements. First, transverse movement of the fuse tube 24 has been observed to result in the application of a bending force to the fuse tube 24. This bending force at times fractures the fuse tube 24, usually in the vicinity of its attachment to the ferrule 72. Second, if the transverse movement of the fuse tube 24 is too severe, the shoulders 76 and 78 and the washer 46 and bushing portion 45*b* do not abut simultaneously. This has been observed to exacerbate both the effect of the bending forces on the fuse tube 24 and the number and severity of fractures thereof. Third, if the transverse movement of the fuse tube 24 is too severe, the contact cap 52 may begin to disengage the concavity 42*a* before the thrust of the fuse tube 24 subsides. Such disengagement may occur before the fuse link has interrupted current and result in arcing between the contact cap 52 and the spring contact 42, thus defeating the very reason for inclusion of the cutout 10 in the circuit. Fourth, as noted earlier, the bushing 45 is pressed into a hole in the recoil bar 32. If this pressing operation is not carried out precisely enough so that the normal shoulder-shoulder 76–78 spacing equals the normal washer-bushing 46–45*b* spacing, the second and third improper results, immediately above, may be worsened.

The above deviations from ideal cutout operation are ameliorated or eliminated by the improved cutout 12 of the present invention. As noted earlier, elements of the improved cutout 12, which are the same as or similar to corresponding elements of the prior art cutout 10, are designated by the same or similar reference numerals.

Figure 4A:
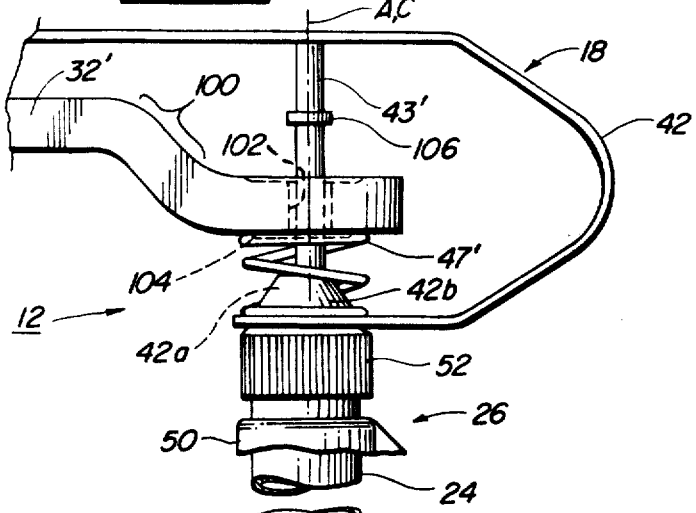
FIGS. 4*a*–4*c* are enlarged elevational views of portions of the cutout of FIG. 3.

Improvements present in the cutout 12, as depicted in FIG. 3, primarily center around improvements in the second or upper contact assembly 18. Specifically, as can be seen from FIG. 3, the recoil bar 32' is similar to the recoil bar 32 of the cutout 10, except that the recoil bar 32' has been formed to have an offset therein substantially as shown at 100. This offset 100 positions the free end of the recoil bar 32' closer to the convexity 42*b* in the spring contact 42 which remains essentially unchanged from that depicted in FIG. 1. The recoil bar 32' also includes near its free end a hole or aperture 102 therethrough (FIGS. 4*a* and 5). Surrounding the hole or aperture 102 on the underside of the recoil bar 32' is a circular raised shoulder 104 (FIG. 4*a*) which is coaxial with the hole 102. A spring 47', which is shorter than the spring 47, acts between the recoil bar 32' and the convexity 42*b* and surrounds both the base of the convexity 42*b* and the shoulder 104. A pin 43' passes freely through the hole or aperture 102 and is connected (similar to the pin 43) between the legs of the J shaped spring contact 42. The pin 43' includes a stop shoulder 106 formed generally centrally thereof.

The construction depicted in FIGS. 3, 4*a* and 5 achieves two ends. First, as described in more detail below, this construction improves the operation of the cutout 12 over that of the cutout 10 and, specifically, ameliorates or eliminates the above-described deviations from ideal cutout operation. Second, the construction illustrated in FIGS. 3, 4*a* and 5 decreases the material costs of the cutout 12 over that of the cutout 10.

Figure 2:
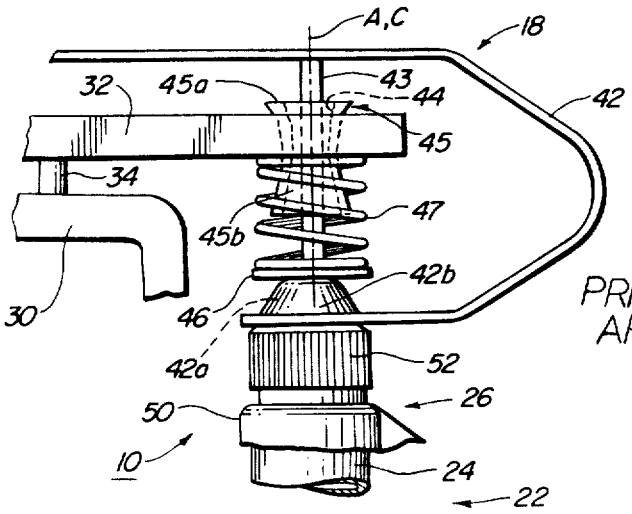
PRIOR ART FIG. 2
FIG. 2 is an enlarged elevational view of a portion of the cutout of FIG. 1
Figure 2A:
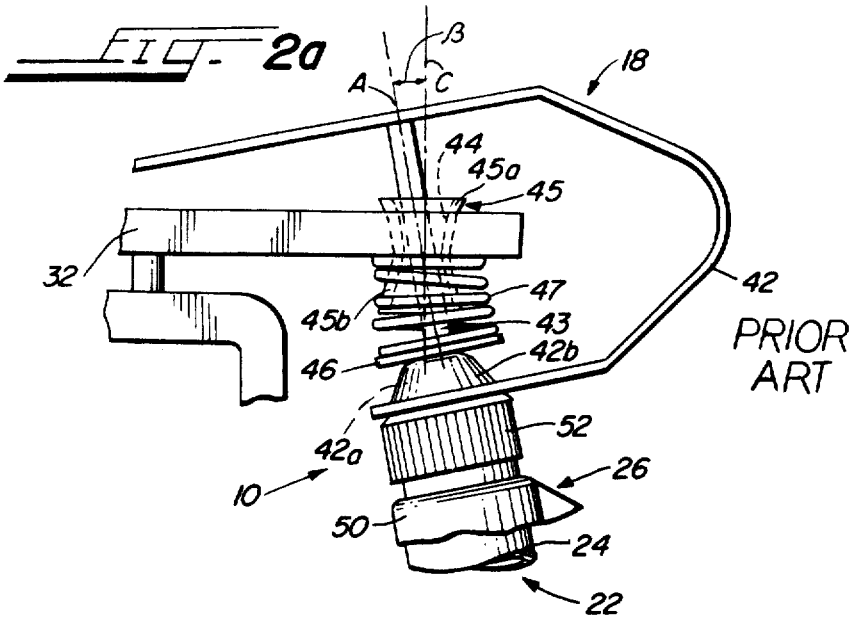
FIG. 2*a* is similar but at a time during the operation thereof.

A material cost decrease of the cutout 12 over that of the cutout 10 is achieved by the elimination of the bushing 45 illustrated in FIGS. 1, 2 and 2*a*, a decrease in the number of turns present in the spring 47 and elimination of the washer 46. The cost decrease achieved by these changes is only partially offset by the fact that the recoil bar 32' must be formed to have the offset 100 and to contain the raised shoulder 104. If convenient, both the offset 100 and the raised shoulder 104 may be formed in a single stamping, pressing or dieing operation.

The elimination of the deviations from ideal cutout operation described with reference to the cutout 10 of FIG. 2*a* is achieved as follows. Referring to FIGS. 4*a* and 5, the offset 100 positions the free end of the recoil bar 32' closer to the convexity 42*b*. This closeness decreases the amount of transverse movement or precession that can be experienced by the pin 43', as shown by the angle B' between the axis A' of the pin 43' and the axis C of the hole 102 in FIG. 5; B' is less than B. Viewing the engagement of the pin 43' with the walls of the hole 102 and the pin's attachment to the convexity 42*b* as the points between which the pin 43' may move or precess, this decrease in the precessable portion of the pin 43' limits the amount of transverse movement which can be experienced by the fuse tube 24 during cutout operation and thereby limits the bending force experienced by the fuse tube 24 to limit or prevent fracturing thereof in the vicinity of the ferrule 72. Also, noting that the distance between the convexity 42*b* and the bottom of the offset recoil bar 32' with the fuse tube assembly 22 in the closed position, illustrated in FIGS. 3 and 4*a*, is equal to the normal spacing between the shoulders 76 and 78, the spacing between the recoil bar 32' and the convexity 42*b* may be more accurately controlled than was the spacing between the pressed in bushing 45 and the washer 46. This more close control over the above-mentioned spacing ensures that during the upward thrust of the fuse tube 24 during operation of the cutout 10, the convexity 42*b* abuts the recoil bar 32' at the same time the shoulders 76 and 78 engage. This ensures that forces on the fuse tube 24 caused by the thrust thereof are equally and simultaneously transferred to the contact assemblies 18 and 20 during operation of the cutout 12. As a consequence of this, and as a consequence of the fact that the pin 43' can precess a more limited amount than can the pin 43 of FIG. 1, both too early opening of the fuse tube assembly 22 and exacerbation of the effect of the bending forces on the fuse tube 24 are limited or eliminated.

Thus, by the simple expedients of eliminating the bushing 45 and the washer 46, and, forming the recoil bar 32', the operation of the cutout 12 has been observed to be greatly improved over that of the cutout 10 illustrated in FIG. 1. Fractures of the fuse tube 24 in the vicinity of the ferrule 72 are all but eliminated, as is too early opening of the fuse tube assembly 22. The limitation of the amount of transverse movement of the fuse tube 24 and precession of the pin 43' effected by the improvement in the upper contact structure 18 are illustrated in FIG. 5 which is similar to, but represents an improvement over FIG. 2*a*.

Figure 4B:
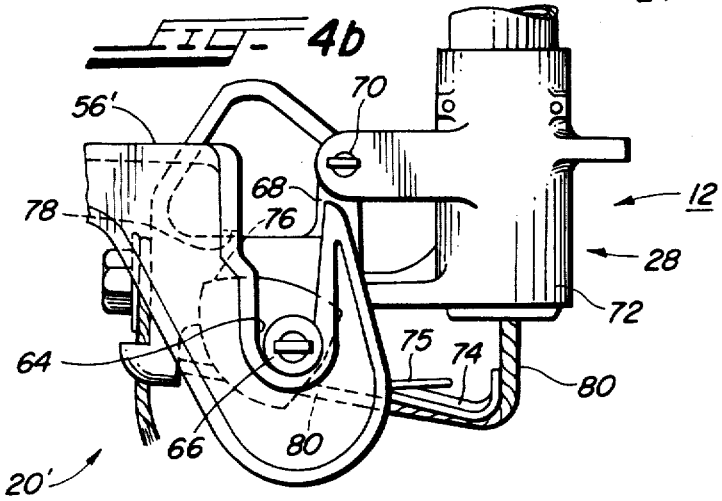
Figure 4C:
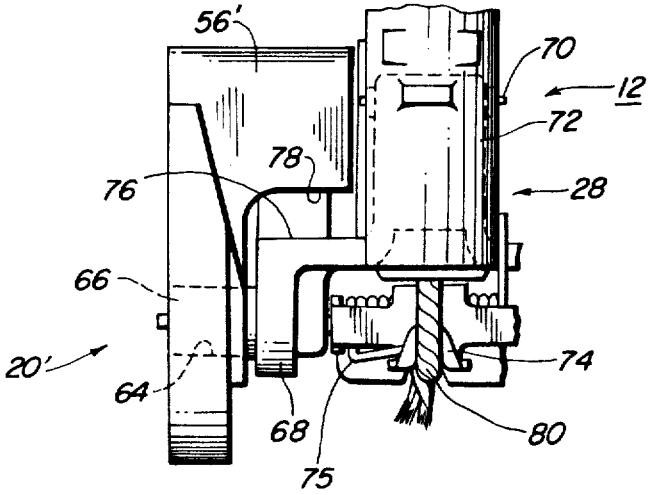

Another improvement in the cutout 12 over that of the cutout 10, but which does not form the subject matter of the present invention, is illustrated by the depiction of the lower contact assembly 20', as shown in FIGS. 3, 4*b*, and 4*c*. Specifically, it will be noted from these figures that the metal content of the support member 56 has been decreased significantly so that the reference numeral 56' is used to indicate the support member of the cutout 12.

It should be noted that the above described improvements in the cutout 12 do not affect the normal or rest spacings between the concavity 42*a* and the trunnion pockets 64. This is to say, the general contour and location of the spring contact member 42 has not been altered by the above improvements. As a consequence, fuse tube assemblies 22 viewed as "standard"—that is, having "standard" lengths—may be used with the improved cutout 12 similar to their use in the prior art cutout 10. Accordingly, complete interchangeability between the fuse tube assemblies 22 used in either cutout 10 or 12 is achieved. This ability to continue to use fuse tube assemblies 22 of standard lengths is obviously important. One solution to the problems of the prior art cutout 10, which was arrived at prior to the derivation of the present invention, involved permitting the recoil bar 32 of FIG. 1 to remain as depicted in that figure and to simply change the contour of the spring contact member 42 to move the short leg thereof closer to the recoil bar 32. Note that while this change in the spring contact member 42 might have the effect of shortening the available length of the pin 43 for precession or random transverse movement, it also changes the distance between the concavity 42*a* and the trunnion pockets 64. Thus, if this intermediate improvement were to be effected, either fuse tube assemblies 22 of non-standard length would be necessary, thus eliminating interchangeability, or the contour and configuration of the lower contact assembly 20 would have to be altered, especially in the vicinity of the trunnion pockets 64 to permit continued use of the standard length fuse tube assemblies 22. Thus, the improvement represented by the cutout 12 involves material savings, improved operation, and the ability to continue to use standard lengths of fuse tube assemblies 22. It also represents a distinct improvement over any proposed solution that involves alteration of the contour and location of either the spring contact member 42 or the first contact assembly 20 or both.

The above described embodiments of the present invention are simply illustrative of the principles thereof. Various other modifications and changes may be devised by those skilled in the art which embody the principles of this invention, yet fall within the spirit and the scope thereof.

I claim:

1. In a cutout mounting having first and second contact assemblies between which a fuse tube of predetermined length is supportable, an improved second contact assembly of the type which includes:

(a) a generally J-shaped spring contact, the long leg of the J being attached to a rigid, recoil bar, a portion of the recoil bar extending into the space between the legs of the J, the short leg of which has a concavity formed therein for selectively receiving an end of the fuse tube and a convexity complementary with the concavity;

(b) a pin freely passing through a hole in the extending portion of the recoil bar and being attached between the long leg and the convexity, both legs being constrained to move together as the pin moves through the hole and the long leg flexes out of a rest location about its point of attachment to the recoil bar; and (c) resilient means acting between the short leg and the recoil bar for setting the rest location of the long leg;

closure of the cutout by rotating the fuse tube in the first contact assembly inserting an end of the fuse tube into the concavity so that the legs are deflected against the action of the resilient means and the flexing of the long leg out of its rest location; operation of the cutout causing the fuse tube to thrust both against and transverse to the concavity, such thrust (i) applying a bending force to the fuse tube which may fracture as a result thereof, (ii) randomly transversely moving the short leg and the pin until the pin engages the walls of the hole, and (iii) further deflecting the legs against the action of the resilient means and the flexing of the long leg; wherein the improvement comprises:

an offset formed in the recoil bar to position the extending portion and the hole substantially closer to the short leg and the convexity to (1) limit the extent of the random transverse motion which the short leg can experience before the pin engages the hole walls, thereby limiting the bending force on the fuse tube, and (2) accurately position the convexity sufficiently close to the recoil bar to accurately limit the amount of movement of the short leg before it engages the recoil bar, thereby earlier transferring force caused by such thrust to the recoil bar.

2. An improved second contact assembly of a fuse cutout, the assembly being of a type including:

(a) a generally J-shaped spring contact, the long leg of the J being attached to a rigid, recoil bar, a portion of the recoil bar extending into the space between the legs of the J, the short leg of which has a concavity formed therein for selectively receiving an end of a fuse tube and a convexity complementary with the concavity;

(b) a pin freely passing through a hole in the extending portion of the recoil bar and being attached between the long leg and the convexity, both legs being constrained to move together as the pin moves through the hole and the long leg flexes out of a rest location about its point of attachment to the recoil bar; and (c) resilient means acting between the short leg and the recoil bar for setting the rest location of the long leg;

closure of the cutout by rotating the fuse tube in a first contact assembly inserting the end of the fuse tube into the concavity so that the legs are deflected against the action of the resilient means and the flexing of the long leg out of its rest location; operation of the cutout causing the fuse tube to thrust both against and transverse to the concavity, such thrust (i) applying a bending force to the fuse tube which may fracture as a result thereof and (ii)

randomly transversely moving the short leg and the pin until the pin engages the walls of the hole; wherein the improvement comprises:

an offset formed in the recoil bar to position the extending portion and the hole substantially closer to the short leg and the convexity to (1) limit the extent of the random transverse motion which the short leg can experience before the pin engages the hole walls, thereby limiting the bending force on the fuse tube, and (2) accurately position the convexity sufficiently close to the recoil bar to accurately limit the amount of movement of the short leg before it engages the recoil bar, thereby earlier transferring force caused by such thrust to the recoil bar.

3. An improved second contact assembly of a fuse cutout; the assembly being of a type including:

(a) a generally J-shaped spring contact, the long leg of the J being attached to a rigid recoil bar, a portion of the recoil bar extending into the space between the legs of the J, the short leg of which has a concavity formed therein for selectively receiving an end of a fuse tube and a convexity complementary with the concavity;

(b) a pin freely passing through a hole in the extending portion of the recoil bar and being attached between the long leg and the convexity, both legs being constrained to move together as the pin moves through the hole and the long leg flexes out of a rest location about its point of attachment to the recoil bar; and (c) resilient means acting between the short leg and the recoil bar for setting the rest location of the long leg;

closure of the cutout by rotating the fuse tube in a first contact assembly inserting the end of the fuse tube into the concavity so that the legs are deflected against the action of the resilient means and the flexing of the long leg out of its rest location; operation of the cutout causing the fuse tube to thrust both against and transverse to the concavity, such thrust (i) applying a bending force to the fuse tube which may fracture as a result of and (ii) randomly transversely moving the short leg and the pin until the pin engages the walls of the hole; wherein the improvement comprises:

an offset formed in the recoil bar to position the extending portion and the hole substantially closer to the short leg and the convexity to decrease the extent to which the pin can pivot between the hole and the convexity so as to limit the extent of the random transverse motion which the short leg can experience before the pin engages the hole walls, thereby limiting the bending force on the fuse tube.

4. In a cutout mounting having first and second contact assemblies between which a fuse tube of predetermined length is supportable, an improved second contact assembly; the fuse tube and the first contact assembly each including normally spaced apart features which engage during cutout operation to apply thrust-caused forces on the fuse tube to the first contact assembly; the second contact assembly being of the type which includes:

(a) generally J-shaped spring contact, the long leg of the J being attached to a rigid, recoil bar, a portion of the recoil bar extending into the space between the legs of the J, the short leg of which has a concavity formed in one side thereof for selectively receiving an end of the fuse tube and a convexity complementary to the concavity;

(b) a pin freely passing through a hole in the extending portion of the recoil bar and being attached between the long leg and the convexity, both legs being constrained to move together as the pin moves through the hole and the long leg flexes out of a rest location about its point of attachment to the recoil bar; and (c) resilient means acting between the short leg and the recoil bar for setting the rest location of the long leg;

closure of the cutout by rotating the fuse tube in the first contact assembly inserting the end of the fuse tube into the concavity so that the legs are deflected against the action of the resilient means and the flexing of the long leg out of its rest location; operation of the cutout causing the fuse tube to thrust both against and transverse to the concavity, such thrust (i) applying a bending force to the fuse tube which may fracture as a result thereof, (ii) randomly transversely moving the short leg and the pin until the pin engages the walls of the hole and (iii) further deflecting the legs against the action of the resilient means and the flexing of the long leg; wherein the improvement comprises:

an offset formed in the recoil bar to position the extending portion and the hole substantially closer to the short leg and the convexity, the distance between the convexity and the recoil bar after closure of the cutout but before the further deflection of the legs being equal to the normal spacing between the features so that after the further deflection of the legs, the thrust-caused force is simultaneously transferred to the first contact assembly and the recoil bar, whereby the extent of the random transverse motion which the short leg can experience until the pin engages the hole walls is limited to limit the bending force on the fuse tube and to prevent the fuse tube from becoming disengaged from the concavity before the thrust of the fuse tube subsides.

5. An improved second contact assembly of a fuse cutout; the assembly being of a type including:

(a) a generally J-shaped spring contact, the long leg of the J being attached to a rigid, recoil bar, a portion of the recoil bar extending into the space between the legs of the J, the short leg of which has a concavity formed therein for selectively receiving an end of a fuse tube and a convexity complementary with the concavity;

(b) a pin freely passing through a hole in the extending portion of the recoil bar and being attached between the long leg and the convexity, both legs being constrained to move together as the pin moves through the hole and the long leg flexes out of a rest location about its point of attachment to the recoil bar; and (c) resilient means acting between the short leg and the recoil bar for setting the rest location of the long leg;

closure of the cutout by rotating the fuse tube in a first contact assembly inserting the end of the fuse tube into the concavity so that the legs are deflected against the action of the resilient means and the flexing of the long leg out of its rest location; operation of the cutout causing the fuse tube to thrust both against and transverse to the concavity, such thrust (i) applying a bending force to the fuse tube which may fracture as a result thereof and (ii) randomly precessing the pin between the walls of the hole and the convexity; wherein the improvement comprises:

an offset formed in the recoil bar to position the extending portion and the hole substantially closer to the short leg and the convexity to decrease the extent to which the pin can precess so as to limit the extent of the random transverse motion which the short leg can experience, thereby limiting the bending force on the fuse tube.

6. An improved second contact assembly as in claim 1, 2, 3 or 5, the fust tube and the first contact assembly being of a type further including normally spaced-apart features which engage after the further deflection of the legs during cutout operation to apply thrust-caused force to the first contact assembly, wherein the improvement further comprises:

the distance between the convexity and the recoil bar after the closure of the cutout, but before the further deflection of the legs, being equal to the normal spacing between the features so that after the further deflection of the legs, the thrust-caused force is simultaneously transferred to the first contact assembly and the recoil bar.

7. The improved second contact assembly of claim 6, wherein the predetermined length of the fuse tube is a standard length which need not be altered for use in the cutout.

8. An improved second contact assembly as in claim 1, 2, 3, 4 or 5, wherein the improvement further comprises:

the resilient means acting directly between the base of the convexity and the recoil bar.

9. An improved second contact assembly as in claim 1, 2, 3, 4 or 5, wherein the improvement further comprises:

the convexity directly abutting the recoil bar during the further deflection of the legs.

10. An improved second contact assembly as in claim 1, 2, 3, 4 or 5 wherein the improvement further comprises:

the resilient means acting between the convexity and the recoil bar.

11. An improved second contact assembly as in claim 9, wherein the improvement further comprises:

the resilient member acting between the convexity and the recoil bar.

12. An improved second contact assembly as in claim 9, wherein the improvement further comprises:

the resilient means acting directly between the base of the convexity and the recoil bar.

* * * * *